US005433637A

United States Patent [19]

Graves

[11] Patent Number: 5,433,637

[45] Date of Patent: Jul. 18, 1995

[54] THROWABLE AIRFOIL FLOATATION DEVICE

[76] Inventor: David A. Graves, 3205 E. 22nd St., Tulsa, Okla. 74114

[21] Appl. No.: 264,707

[22] Filed: Jun. 23, 1994

[51] Int. Cl.[6] ..... B63C 9/00

[52] U.S. Cl. ..... 441/80; 411/81

[58] Field of Search ..... 441/67, 80, 81, 83, 441/84, 87, 88, 106, 108-112, 113, 122, 123, 125-132, 136; 446/48

[56] References Cited

U.S. PATENT DOCUMENTS

| | | | |
|---|---|---|---|
| D. 226,506 | 3/1973 | Brill | D71/1 HH |
| D. 274,141 | 6/1984 | Carrillo | D12/316 |
| D. 302,719 | 8/1989 | Hance et al. | D21/237 |
| D. 305,449 | 1/1990 | Rundquist, Jr. | D21/237 |
| 650,986 | 6/1900 | Omeyer | 441/80 |
| 1,236,365 | 8/1917 | Rogers | 441/81 |
| 1,743,333 | 1/1930 | Ely | 441/131 |
| 1,749,820 | 3/1930 | Johnson | 441/131 |
| 2,105,110 | 1/1938 | Driscoll et al. | 9/17 |
| 2,342,868 | 2/1944 | King | 9/17 |
| 2,373,994 | 4/1945 | Brandsten | 9/17 |
| 3,032,789 | 5/1962 | Fedorowicz | 9/340 |
| 3,074,084 | 1/1963 | Bisch | 9/347 |
| 3,111,696 | 11/1963 | To Lo | 9/340 |
| 3,113,396 | 12/1963 | Collins | 46/74 |
| 3,579,683 | 5/1971 | Robertson | 9/340 |
| 3,710,505 | 1/1973 | Linenfelser | 46/74 D |
| 4,059,859 | 11/1977 | Hull | 9/340 |
| 4,135,325 | 1/1979 | Lehman | 46/74 D |
| 4,362,518 | 12/1982 | Boissiere | 441/60 |
| 4,416,640 | 11/1983 | Eickenhorst | 441/81 |
| 4,498,880 | 2/1985 | Curley | 441/81 |
| 4,538,998 | 9/1985 | Holzel | 441/122 |
| 4,540,372 | 9/1985 | Mauck | 441/81 |
| 4,701,145 | 12/1987 | Foresman | 441/131 |
| 4,936,804 | 6/1990 | Dowdeswell | 441/6 |
| 4,976,642 | 12/1990 | Wilkie | 441/131 |
| 4,979,922 | 12/1990 | Clark | 446/46 |
| 5,224,891 | 7/1993 | Stephens | 441/130 |

OTHER PUBLICATIONS

Jay Shelton 1975, The Physics of Frisbee Flight, *Frisbee. A Practitioner's Manual and Definitive Treatise.*

*Primary Examiner*—Edwin L. Swinehart
*Attorney, Agent, or Firm*—Molly D. McKay

[57] ABSTRACT

A floatation device in the shape of a throwable airfoil, similar to the shape of a FRISBEE ® brand toy, which can also be used as a cushion to sit upon. The device is comprised of a supporting structure which attaches to a bottom surface of a floatation structure. The supporting structure is preferably constructed of semi-rigid material which functions to maintain the proper shape of the device and is provided with a handle which is gripped by a person in order to throw the device. The floatation structure is preferably constructed of a soft, resilient material, such as polyvinyl chloride foam. The device is optionally provided with straps, arm holes, and central openings for holding onto the device when in the water and, optionally, provided with a bumper ring and a retractable handle mechanism for cushioning the impact of the device.

21 Claims, 8 Drawing Sheets

THROWABLE AIRFOIL FLOATATION DEVICE

BACKGROUND OF THE INVENTION

1. Field of the Invention

The present invention relates to a floatation device for keeping a person afloat in the water and which is provided with an internal supporting structure and an external soft floatation structure so it can be thrown accurately over long distances.

2. Description of the Related Art

Floatation devices are effective tools in preventing drownings. Personal floatation devices come in an array of shapes and sizes. One general group of these devices includes life vests and life jackets which are secured directly to respectively a person's chest or waist in order to keep the person afloat when the person is in the water.

Another general group of these floatation devices do not secure to the person's body but are instead grasped by the person by means of straps attached to the device or by the person inserting an arm over, around or through the device. Examples of devices which fall in this second group of floatation devices include air mattresses, inflated inner tubes, and a variety of ring-type life preservers. Because devices included in this second group of floatation devices are not secured to the person's body, the person may not have access to one of these floatation devices when they are in the water, particularly if the person has been suddenly thrown into the water, for example in a boating accident. In that case, in order to place a floatation device within the person's grasp, the device is normally thrown to the person by someone located on the shore, in a boat, etc. Often the person throwing the device must toss it a considerable distance in order to reach the person who is in need of it.

One problem encountered by previous floatation devices is they are limited in the distance they can be thrown and the accuracy with which they can be thrown. The present invention addresses this problem by employing the aerodynamic principles used in constructing throwable airfoils, such as Frisbee® brand toys, in order to create a floatation device which can be accurately thrown over fairly long distances. In order to accomplish this, the present invention is provided with an internal- semi-rigid support structure which allows the device to maintain its shape as it is gripped to be thrown and while it is in the air after being thrown. The support structure also serves to increase the concentration of mass away from the center of the device which in turn increases both the angular momentum and the stability of the design according to commonly known principles of physics governing the flight of throwable airfoils.

The present invention is also provided with an external soft floatation structure which will not injure a person who is struck by the device as it is being thrown to them. The floatation structure is the proper shape to impart the desired aerodynamic characteristics to the device, thus enabling it to be thrown accurately over long distances.

SUMMARY OF THE INVENTION

Briefly, the invention is a floatation device comprising two basic parts, an internal support structure and an external floatation structure. The internal support structure attaches to the bottom side of the external floatation structure by means of Velcro® brand strips, by means of extensions provided on a perimeter of the external floatation structure which holds the internal support structure within a concave portion of the external floatation structure or by other suitable attachment means. Various configurations of the internal support structure are possible. The main features of the support structure are provision of a handle by which the device can be gripped in order to throw it, construction of a semi-rigid material which forms the backbone of the floatation device in order to hold it in its desired shape, and means to attach the support structure to the floatation structure. The main features of the floatation structure are construction of a resilient, flexible material which is sufficiently buoyant to support a person in the water, shape in the form of an airfoil and means provided on the external floatation structure for gripping the device. The means for gripping the device may include, for example, straps, arm holes, and central openings.

DETAILED DESCRIPTION OF THE PREFERRED EMBODIMENT

Figure 1:
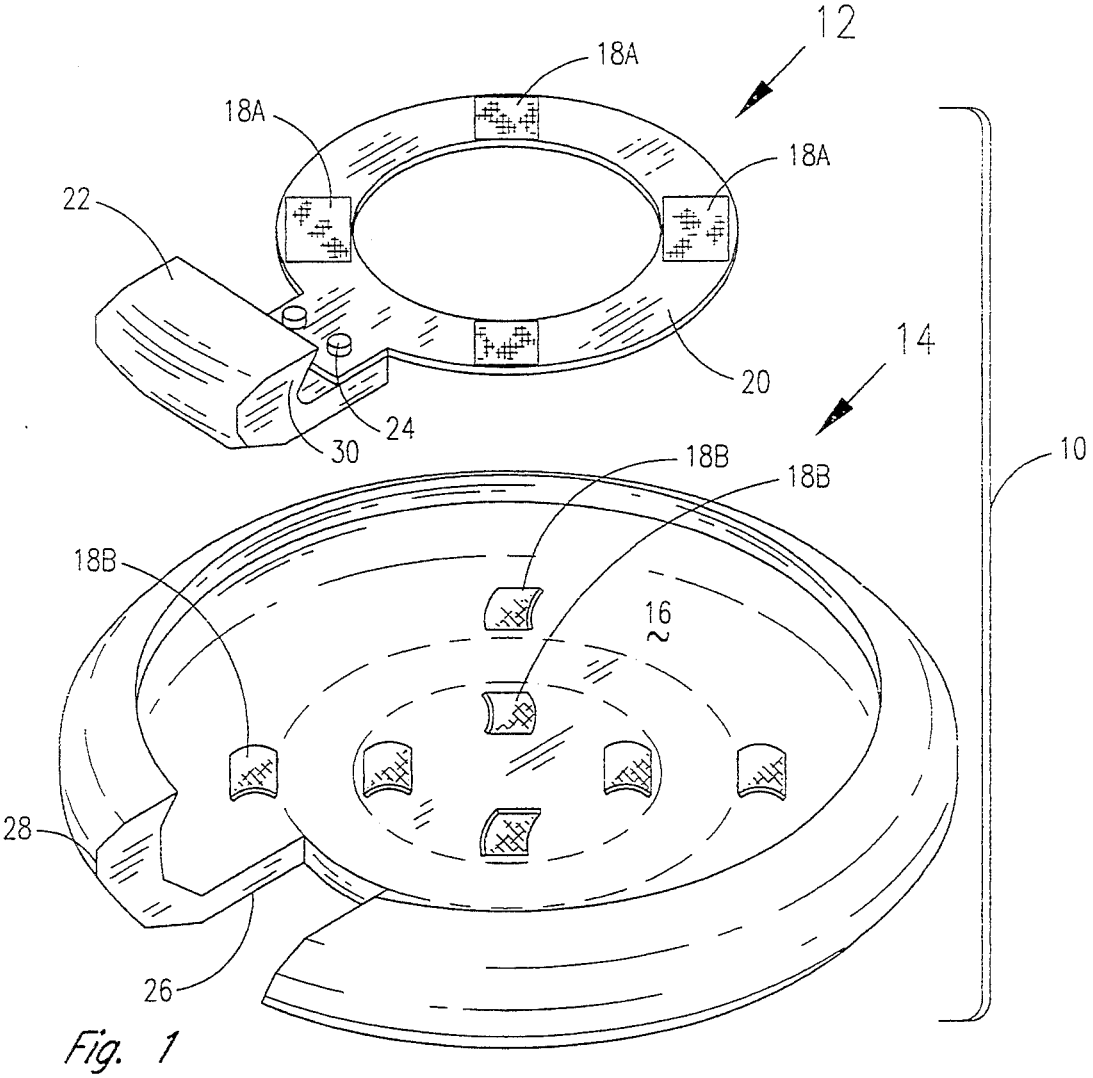
FIG. 1 is an exploded perspective view looking at a floatation device constructed according to a preferred embodiment of the present invention which has been inverted to show the concave underneath side of the floatation structure and the attachment means for securing a supporting structure to the floatation structure.
Figure 2:
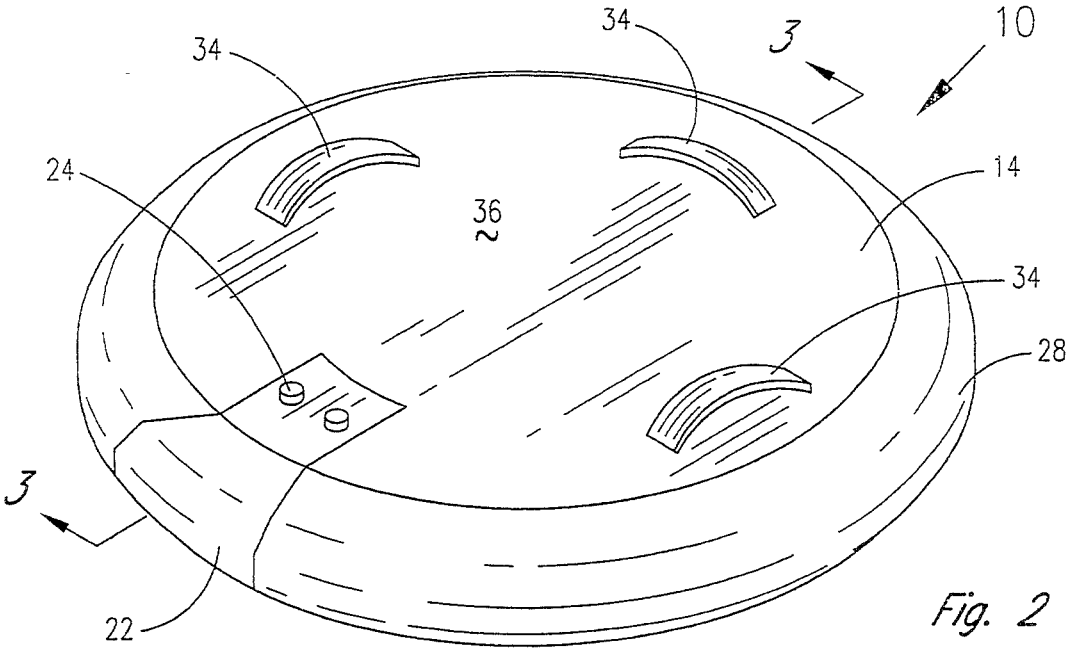
FIG. 2 is a perspective view showing the top surface of the device illustrated in FIG. 1.
Figure 3:
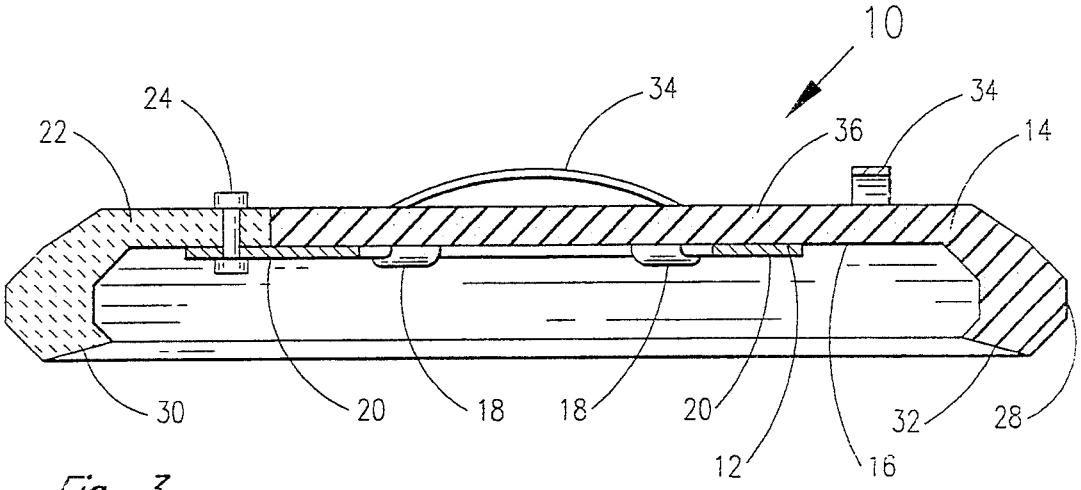
FIG. 3 is a cross-sectional view taken along line 3—3 of FIG. 2.

Referring now to the drawings and initially to FIGS. 1 through 3, there is illustrated a floatation device 10 constructed according to a preferred embodiment of the present invention. The floatation device 10 is comprised of two basic parts: an internal support structure 12 and an external floatation structure 14. The internal support structure 12 is preferably constructed of a semi-rigid material and the external floatation structure 14 is preferably constructed of a soft, resilient and buoyant material, such as polyvinyl chloride foam. The internal support structure 12 attaches, either permanently or removably, to a bottom surface 16 of the floatation structure 14. FIG. 1 shows interlocking hook and loop fastener strips (referred to collectively as numeral 18) 18A and 18B, such as Velcro® hook and loop fastener, provided respectively on the internal support structure 12 and the bottom surface 16 of the floatation structure 14, or alternately although not specifically illustrated, on the floatation structure 14 alone so that the strips 18A and 18B extend around the internal support structure 12 as a means of removably attaching the structures 12 and 14 together. Although strips 18A and 18B are illustrated, other similar attachment means are possible as a means of removably or permanently attaching structures 12 and 14 together.

As illustrated in the embodiment shown in FIG. 1, the support structure 12 consists of a ring portion 20 to which a handle 22 secures by means of bolts 24 or other similar attachment means. The handle 22 is preferably constructed of a rigid, lightweight material, for example, rigid, dense polyethylene foam, so that it is strong enough for gripping the device 10, but lightweight enough in order to maintain the proper mass distribution of the device 10. Strip 18A may also attach to ring portion 20 on those devices 10 which employ strips 18A and 18B and which do not have both strips 18A and 18B attached solely to the floatation structure 14. The handle 22 is shaped so that it inserts into a gap 26 provided in a perimeter 28 of the floatation structure 14, as illustrated in FIG. 2. The handle 22 has the same cross-sectional shape as the perimeter 28, including an inwardly and downwardly oriented lip 30 which matches an inwardly and downwardly oriented extension 32 provided on the perimeter 28. The extension 32 imparts a proper concave shape to the device 10, as best shown in FIG. 3.

A person attempting to grasp the device 10 in order to throw it, would grip the handle 22 similar to the way a person would grip a Frisbee® brand toy when preparing to throw it. The device 10 illustrated in FIGS. 1 through 3 is also provided with a plurality of straps 34 located on a top surface 36 of the floatation structure 14 in order that the device 10 can be easily clutched in the hand of a person located in the water.

Figure 4:
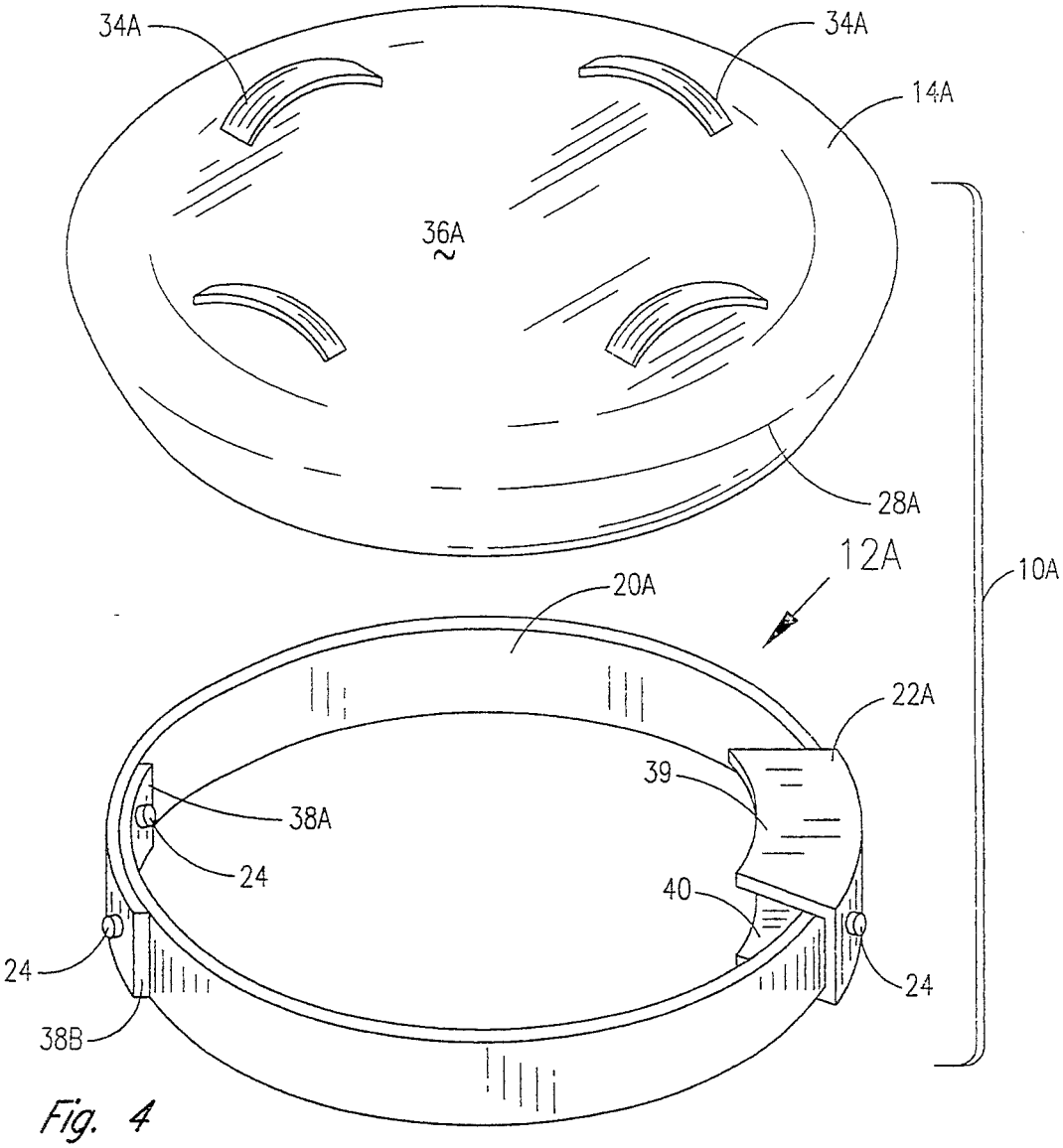
FIG. 4 is an exploded perspective view of a second embodiment of the present invention.
Figure 5:
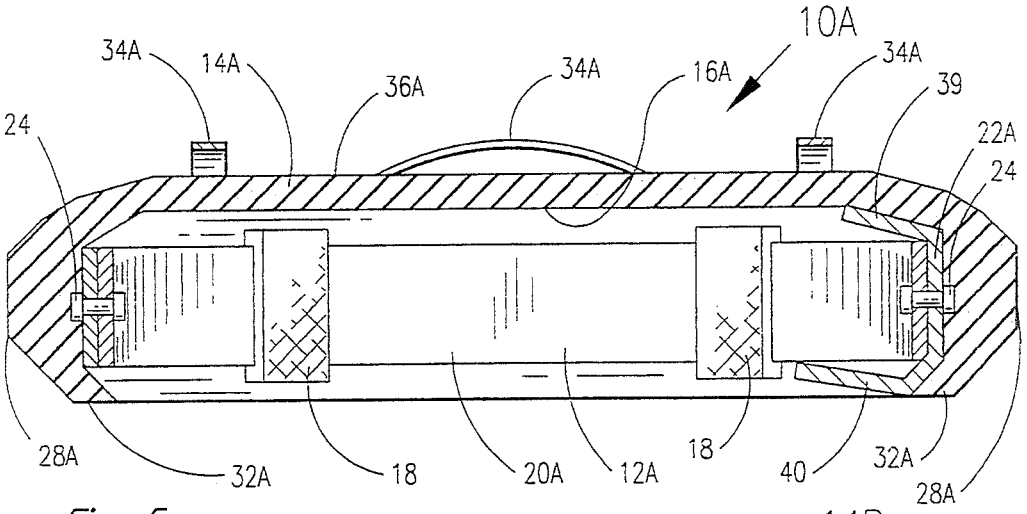
FIG. 5 is a cross-sectional view of the device shown in FIG. 4 taken through the handle.

FIGS. 4 and 5 illustrate a second embodiment of the device 10 which is referred to hereafter and in the drawings as 10A. Device 10A has a modified internal support structure 12A consisting of a modified ring portion 20A having ends 38A and 38B which are secured together by means of bolts 24 or other similar attachment means and consisting of a modified handle 22A. The modified handle 22A is attached to the modified ring portion 20A by means of bolts 24 or other similar attachment means.

As illustrated in FIG. 5, the entire modified internal support structure 12A, including the modified ring portion 20A and the modified handle 22A, is removably attached to a modified bottom surface 16A of a modified floatation structure 14A by means of an inwardly and downwardly oriented modified extension 32A provided on a modified perimeter 28A which is similar to the extension 32 provided on perimeter 28, as illustrated in FIGS. 1 and 3. The extension 32A is preferably constructed of a buoyant, resilient material such that it holds the support structure 12A in place adjacent the bottom surface 16A. Additionally, hook and loop type fasteners 18 may also be employed to secure structures 12A and 14A together. The handle 22A is specifically provided with inclined upper and lower surfaces 39 and 40 which allow the handle 22A to be held in place within the floatation structure 14A while still providing the gripping surfaces necessary for someone to grasp and throw the device 10A.

In order to throw the device 10A, a person first squeezes around a modified perimeter 28A of the device 10A in order to locate the handle 22A and then grasps the device 10A at the handle 22A to throw it, similar to the manner previously described for device 10. The device 10A is also provided with a plurality of modified straps 34A located on a top surface 36A of the floatation structure 14A, similar to the straps 34 illustrated in FIGS. 2 and 3 for device 10.

Figure 6:
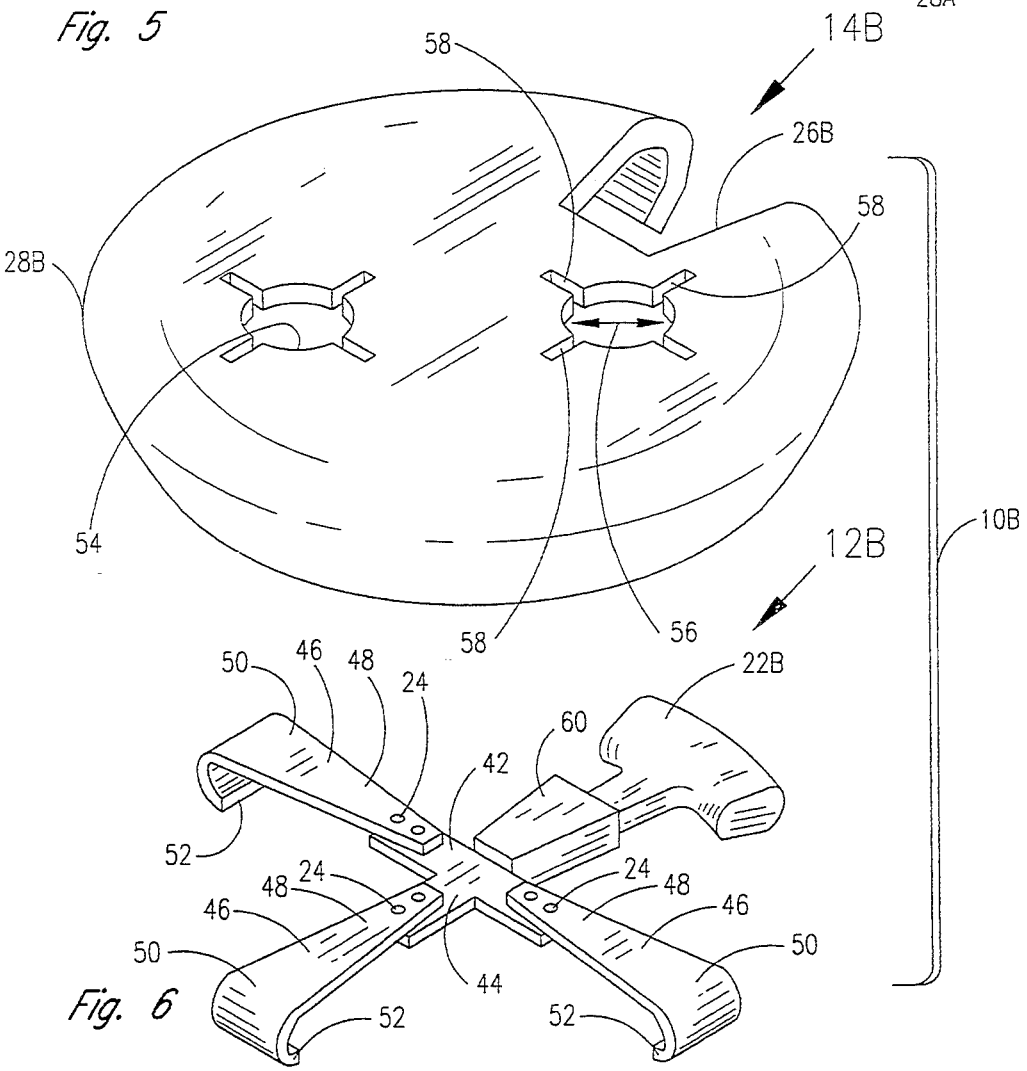
FIG. 6 is an exploded perspective view of a third embodiment of the present invention.
Figure 7:
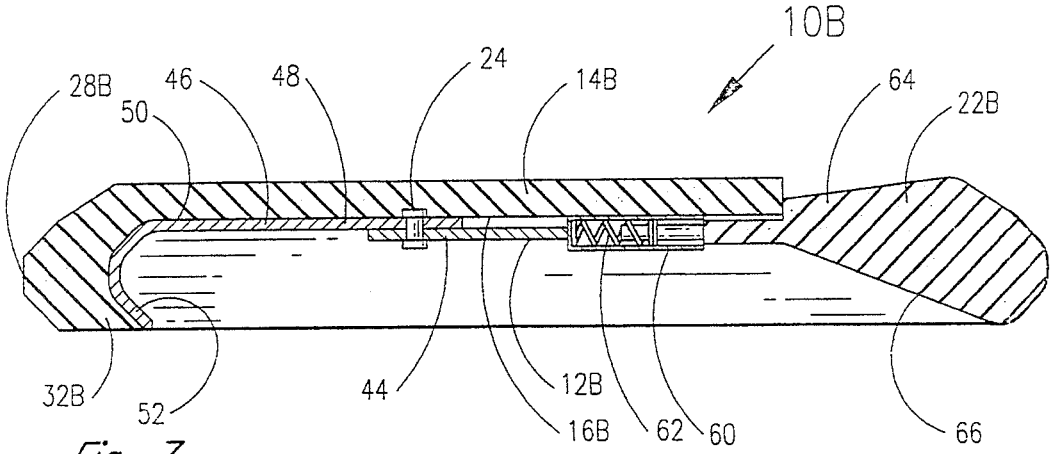
FIG. 7 is a cross-sectional view of the device illustrated in FIG. 6 taken through the handle.

FIGS. 6 and 7 illustrate a third embodiment of the device, which is referred to hereafter and in the drawings as 10B. The device 10B has an alternate internal support structure 12B consisting of a spoked portion 42 and an alternate handle 22B. The spoked portion 42 is comprised of a rigid central hub 44 and a plurality of flexible spokes 46 which attach to the central hub 44 by means of bolts 24 or other similar attachment means. Each spoke 46 is provided with a narrow proximal end 48 which is attached to the central hub 44 by means of bolts 24 or other similar attachment means. Each spoke 46 is also provided with an opposite broader distal end 50 which is provided with a down-turned edge 52. It is desirable that the distal end 50 be broader than the proximal end 48 so that most of the mass of the spokes 46 is concentrated near an alternate perimeter 28B provided on an alternate floatation structure 145 of the device 10B, imparting greater stability to the device 10B when it is thrown.

The alternate floatation structure 14B is provided with an inwardly and downwardly oriented alternate extension 32B. Alternate extension 32B is provided on the perimeter 28B of the floatation structure 14B, similar to the extension 32 previously described for device 10. The extension 32B engages the down-turned edges 52 of the spokes 46 in order to removably attach the support structure 12B to a bottom surface 16B of the floatation structure 14B, as best illustrated in FIG. 7.

Referring back to FIG. 6, the floatation structure 14B of device 10B is provided with an alternate gap 26B which is similar to the gap 26 which was previously described for device 10. The alternate handle 22B extends into the gap 26B, as illustrated in FIG. 7, and serves as a place to grip the device 10B when a person is preparing to throw it.

The floatation structure 14B is optionally provided with a plurality of arm holes 54 which extend all the way through the floatation structure 14B. The arm holes 54 are preferably provided with a small central opening 56, having a diameter somewhat smaller than a diameter of a person's arm. Each arm hole 54 is provided with a plurality of slits 58 which radiate outwardly from the central opening 56 of the arm hole 54. The purpose of the slits 58 is to allow a person's arm to enter the arm holes 54 and once entered, the resilient material from which the floatation structure 14B is constructed, will tend to wedge the arm within the arm hole 54, thus allowing a person to be held within the device 10B and suspended in the water without the person exerting any continuing effort to hold onto the device 10B. These arm holes 54 would be particularly useful in situations involving hypothermia, injuries, very young or very old people, or when the person must remain in the water for an extended time.

The alternate handle 22B automatically retracts inward toward the central hub 44 upon striking an object, such as a person in the water. The handle 22B attaches to the central hub 44 by means of an attachment chamber 60. The attachment chamber 60 is provided internally with a spring 62 which normally biases the alternate handle 22B outwardly. Upon impact with an object, the alternate handle 22B presses against the spring 62, allowing the handle 22B to retract slightly away from the perimeter 28B, thus cushioning the impact of the handle 22B with the object. Immediately following the impact, the spring 62 returns to its previous decompressed configuration, forcing the handle 22B outward again to the position it occupied prior to the impact.

When moving inwardly from the perimeter 28B toward the central hub 44, the handle 22B has a downwardly sloping upper surface 64 and an upwardly sloping lower surface 66. These sloping surfaces 64 and 66 make gripping the handle 22B easier.

Figure 8:
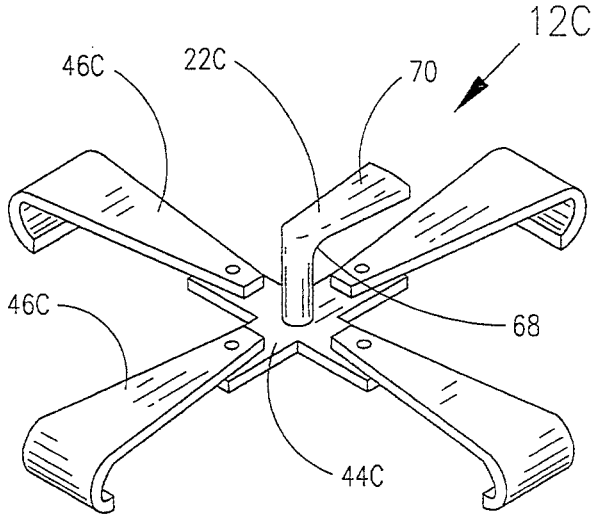
FIG. 8 is a second alternate support structure which attaches to a floatation structure and which is provided with a handle allowing the device to be thrown side-armed.
Figure 14:
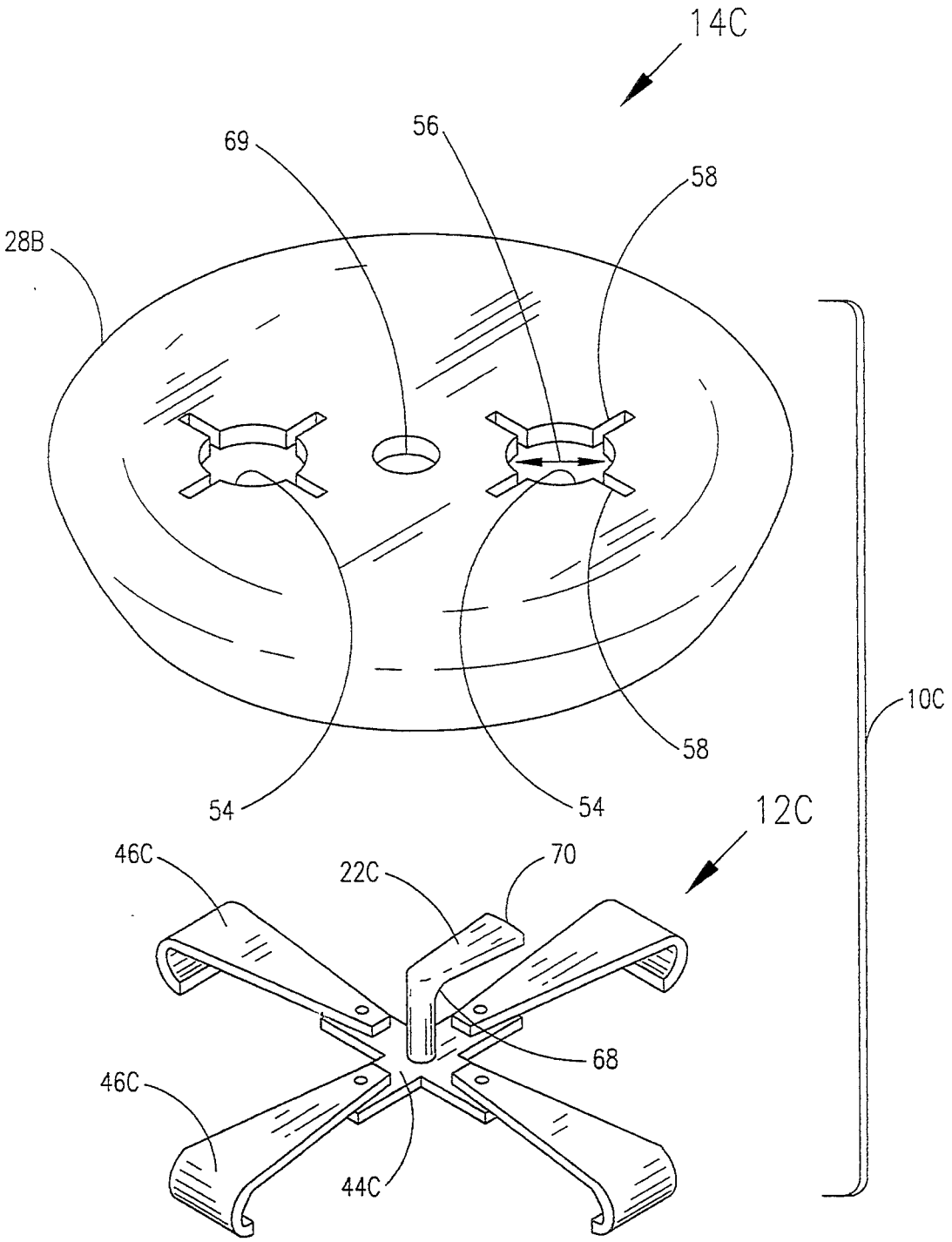
FIG. 14 is an exploding perspective view of a modified third embodiment of the present invention.

FIG. 8 is a second alternate internal support structure, which is referred to hereafter and in the drawings as 12C. Support structure 12C is similar to the support structure 12B in that it has a plurality of flexible alternate spokes 46C which are attached to an alternate central hub 44C, similar to the plurality of spokes 46 and central hub 44 previously described for support structure 12B. However, support structure 12C differs from support structure 12B in design and attachment of its second alternate handle 22C. Handle 22C permanently attaches to the central hub 44C perpendicular to the spokes 46C and extends upward from the central hub 44C a short distance before making a 90° bend 68 and ending with a distal end 70 which lies generally parallel to a plane in which the spokes 46C and the central hub 44C lie. As shown in FIG. 14, a modified third embodiment 10C is created when [S]support structure 12C is used in conjunction with a floatation structure 14C [(not illustrated)] which is similar to floatation structure 14B, except that it does not have a gap 26B but rather is provided centrally with a handle opening 69 [(not illustrated)] through which handle 22C extends. The handle 22C of support structure 12C is designed to allow the person who is throwing the device 10 to throw in a side arm fashion rather than in a backhand fashion.

Figure 9:
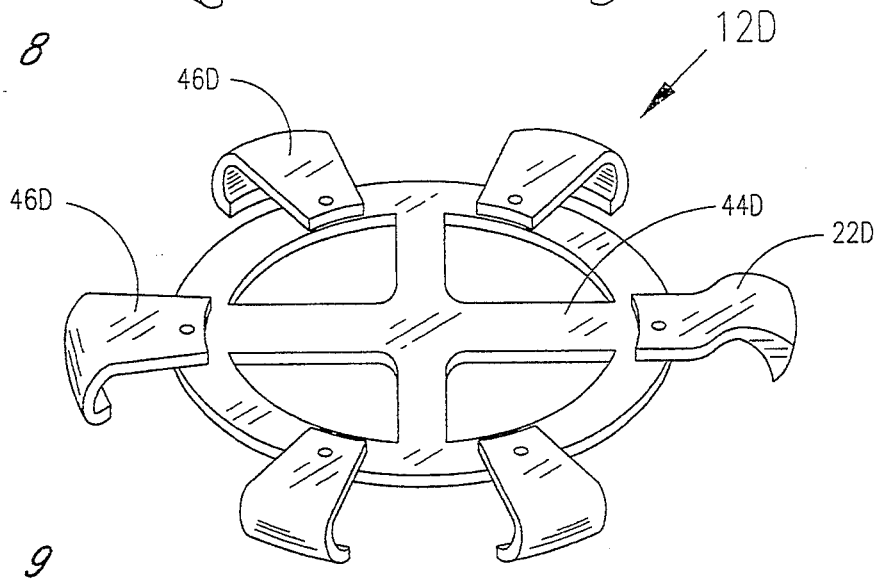
FIG. 9 is a third alternate support structure which attaches to a floatation structure.

FIG. 9 is a third alternate internal support structure, which is referred to hereafter and in the drawings as 12D. Support structure 12D is similar to support structure 12B except that it has a modified ring-shaped central hub 44D instead of the central hub 44, has a permanently attached stationary handle 22D instead of the retractable handle 22B, and has modified spokes 46D. Support structure 12D is employed in conjunction with a floatation structure (not illustrated) similar to floatation structure 14B.

Figure 10:
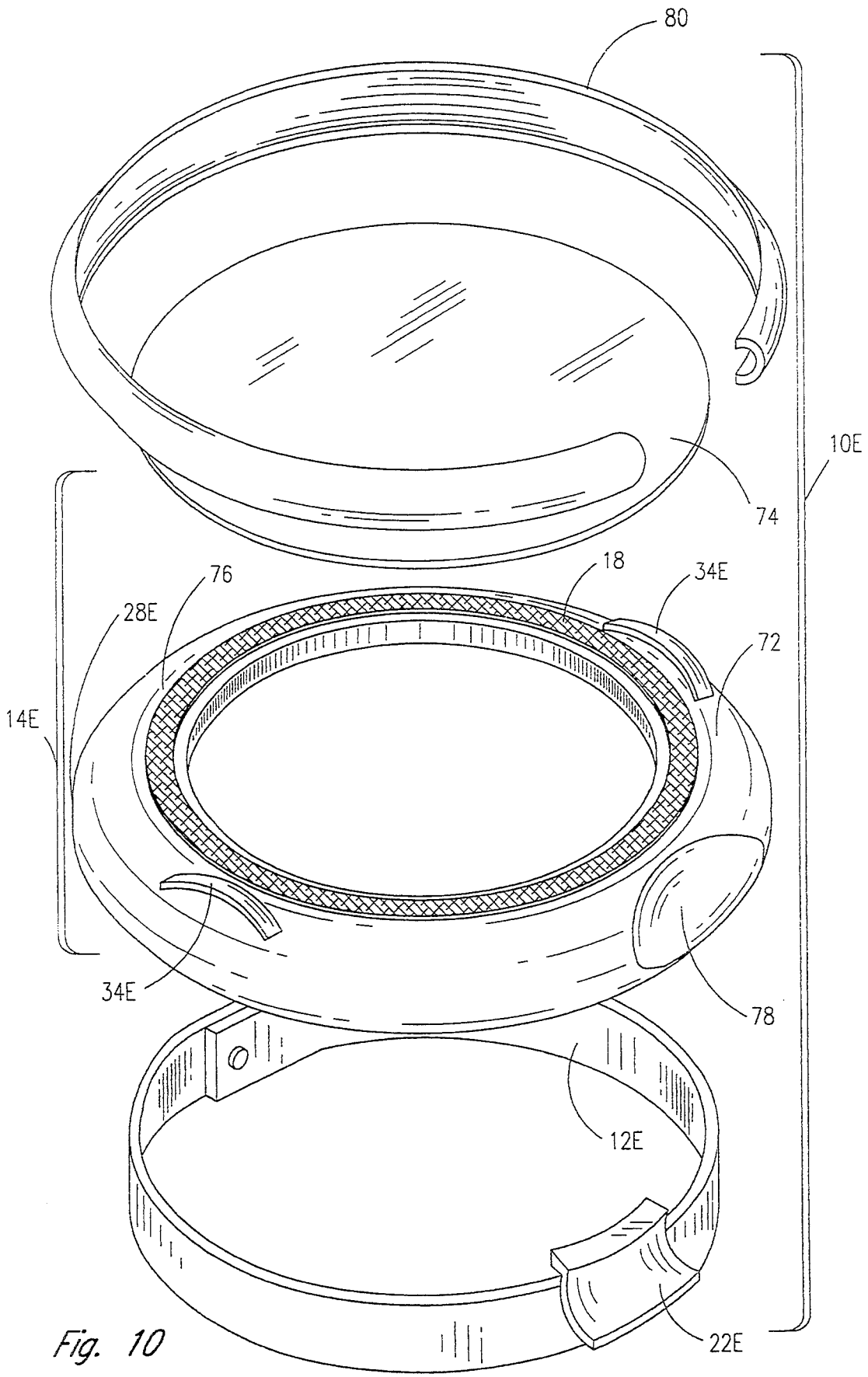
FIG. 10 is an exploded perspective view of a fourth embodiment.
Figure 11:
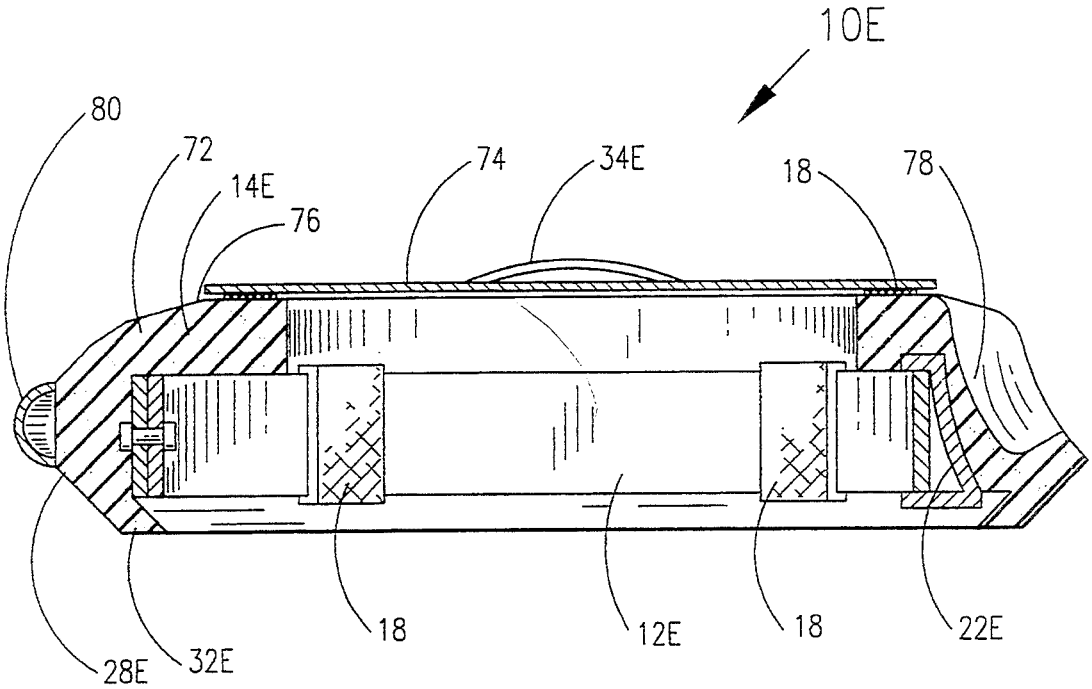
FIG. 11 is a cross-sectional view of the device shown in FIG. 10 taken through the handle.

FIGS. 10 and 11 illustrate a fourth embodiment of the device, which is referred to hereinafter and in the drawings as 10E. The device 10E employs a support structure 12E, similar to support structure 12B previously ,described, and a ring-type floatation structure 14E. Support structure 12E is provided with a handle 22E similar to handle 22A previously described. The floatation structure 14E is comprised of a hollow ring 72 which is provided with a ring extension 32E located on a ring perimeter 28E, similar to extension and perimeter 32 and 28 previously described, and a circular piece of material 74 which removably attaches to a top surface 76 of the ring 72 via hook and loop fasteners 18 such as Velcro® brand strips or other similar attachment means. The purpose of the circular piece of material 74 is to provide the proper shape of an airfoil to the device 10E. The ring 72 is provided with ring straps 34E as a means for holding onto the device 10E when in the water. The circular piece of material 74 may be completely removed and the device 10E may be grasped by inserting an arm through hollow ring 72 or alternately, the device 10E may be placed around a person by placing it over the person's head and shoulders.

The perimeter 28E is provided with an indentation 78 by which a person can grasp the device 10E in order to throw it. Optionally, interlocking hook and loop fasteners 18 such as VELCRO® hook and loop fasteners or other similar attachment means are provided respectively on the support structure 12E and the floatation structure 14E or alternately on the floatation structure 14E alone so that they extend around the support structure 12E as a means of removably attaching together the support and floatation structures 12E and 14E.

The device 10E is optionally provided with a bumper ring 80 which attaches around the perimeter 28E, except at the indentation 78. The bumper ring 80 is preferably constructed of a resilient material such that when it strikes an object, such as a person, it moves slightly inward. Immediately after impact, the bumper ring 80 will again return to its pre-impact configuration, thus providing additional cushion to an impact with the perimeter 28E of the device 10E.

Figure 12:
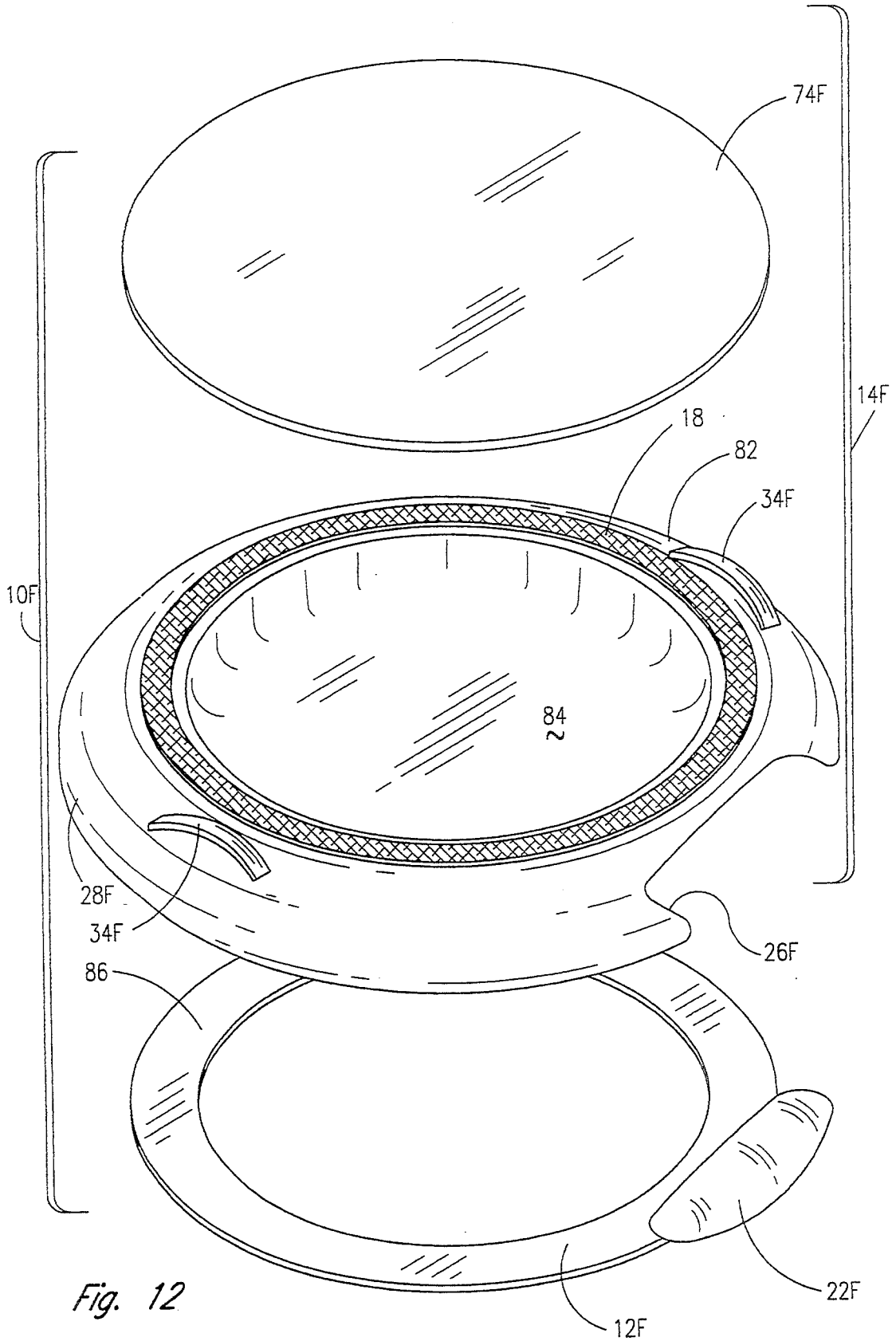
FIG. 12 is an exploded perspective view of a fifth embodiment.
Figure 13:
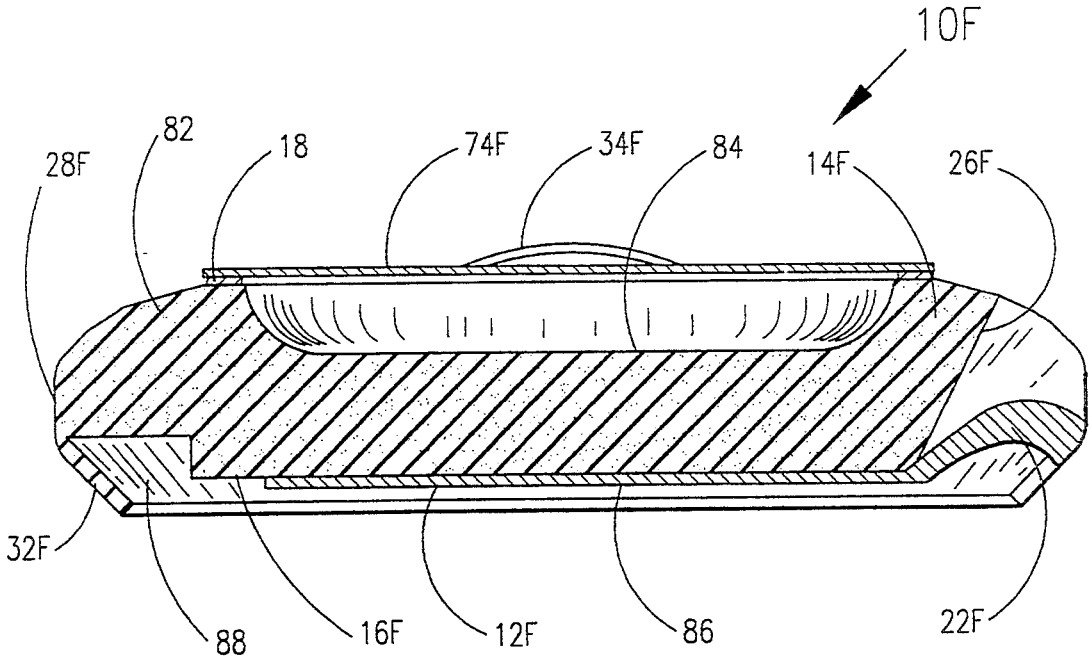
FIG. 13 is a cross-sectional view of the device shown in FIG. 12 taken through the handle.

FIGS. 12 and 13 illustrate a fifth embodiment. A fifth embodiment of the device, which is referred to hereinafter and in the drawings as 10F, is designed to serve a dual function as a seat cushion on which an individual can sit and as a floatation device. The device 10F has a floatation structure 14F, similar to floatation structure 14E except it is provided with a disk 82 instead of the hollow ring 72. The disk 82 is provided with an indented top surface 84 over which a circular piece of material 74F attaches by means of hook and loop fasteners 18 or other similar attachment means as previously described for attaching the circular piece of material 74 to the device 10E. The purpose of the circular piece of material 74F is to provide the proper shape of an airfoil to the device 10F. The disk 82 is also provided with disk straps 34F as a means for holding onto the device 10F when in the water.

Device 1OF employs a one-piece support structure 12F having a circular portion 86 which secures to a bottom surface 16F of the disk 82 and having a handle 22F which extends slightly upward at an angle from the circular portion 86. The handle 22F inserts within a gap 26F provided in the floatation structure 14F. The floatation structure 14F is provided with an extension 32F located at perimeter 28F. The extension 32F is flexible upward such that when a person sits on the circular piece of material 74F, the extension 32F flexes upward. The extension 32F moves back downward to its original position when the person rises off the device 10E. The disk 82 is provided with a space 88 adjacent to the extension 32F into which the extension 32F can flex when a person sits on the device 10F.

While the invention has been described with a certain degree of particularity, it is manifest that many changes may be made in the details of construction and the arrangement of components without departing from the spirit and scope of this disclosure. Specifically, it is understood that any of the various support structures may be used with any of the various floatation structures. It is understood that the invention is not limited to the embodiments set forth herein for the purposes of exemplification, but is to be limited only by the scope of the attached claim or claims, including the full range of equivalency to which each element thereof is entitled.

What is claimed is:

1. A floatation device which can be accurately thrown over long distances comprising:

a support structure being provided with a handle, said support structure being attached to a floatation structure, said floatation structure being concave in shape, and said floatation structure being provided with means for holding onto the device while in the water.

2. A floatation device according to claim 1, wherein said means for holding onto the device comprises straps being provided on the floatation structure.

3. A floatation device according to claim 1 wherein said means for holding onto the device comprises the floatation structure being provided with arm holes therein.

4. A floatation device according to claim 1 further comprising the floatation structure being provided with a removably attached circular piece of material.

5. A floatation device according to claim 1 wherein said means for holding onto the device comprises said floatation structure being comprised of a hollow ring and a circular piece of material removably attached to a top surface of said ring.

6. A floatation device according to claim 1 further comprising said handle being movably attached to said support structure by means of an attachment chamber, said attachment chamber being provided with a spring which normally biases said handle outward and upon impact of the handle with an object, will momentarily be compressed to allow the handle to move inward.

7. A floatation device according to claim 1 further comprising a proximal end of said handle being attached perpendicularly to said support structure, said handle extending through said floatation structure via an opening provided in said floatation structure, a bend of approximately 90° being provided in the handle, and a distal end of said handle lying approximately parallel with said support structure.

8. A floatation device according to claim 1 wherein said support structure attaches to a bottom side of said floatation structure by attachment means.

9. A floatation device according to claim 8 wherein said attachment means comprise hook and loop fasteners.

10. A floatation device according to claim 8 wherein said attachment means comprise an extension provided on a perimeter of said floatation structure which engages said support structure.

11. A floatation device according to claim 10 wherein said support structure is further attached to said floatation structure by means of hook and loop fasteners.

12. A floatation device according to claim 1 wherein said support structure is semi-rigid.

13. A floatation device according to claim 1 wherein said floatation structure is a soft, resilient material.

14. A floatation device according to claim 13 wherein said soft, resilient material is polyvinyl chloride foam.

15. A floatation device according to claim 1 further comprising said floatation structure being provided with a gap into which said handle extends.

16. A throwable floatation device which also doubles as a seat cushion comprising:

a semi-rigid support structure, a handle being provided on said support structure, said support structure being attached to a concave bottom surface of a floatation structure, said floatation structure being provided with means for holding onto the device while in the water.

17. A throwable floatation device according to claim 16 wherein said floatation structure is comprised of a single unit of buoyant material.

18. A throwable floatation device according to claim 16 wherein said floatation structure is comprised of a hollow ring of buoyant material and a circular piece of material removably attached to a top surface of said ring.

19. A throwable floatation device according to claim 16 further comprising said floatation structure being provided with an inwardly and downwardly oriented flexible extension located at a periphery of said floatation structure.

20. A throwable floatation device according to claim 16 further comprising said floatation structure being provided with a space into which said extension can flex when said device is sat upon by a user.

21. A throwable floatation device according to claim 16 further comprising a bumper ring provided on a periphery of said floatation structure, said bumper ring being flexible so that it flexes inward toward said periphery upon impact with an object and returns to its original shape immediately after impact.

* * * * *